United States Patent [19]

Wall

[11] Patent Number: 4,758,826

[45] Date of Patent: Jul. 19, 1988

[54] WORK AREA ADVANCED WARNING SYSTEM

[76] Inventor: Richard E. Wall, 3701 E. Poinsetta Dr., Phoenix, Ariz. 85028

[21] Appl. No.: 777,912

[22] Filed: Sep. 19, 1985

[51] Int. Cl.[4] ..... G08B 3/00

[52] U.S. Cl. ..... 340/691; 340/539; 340/696; 340/590; 340/385; 340/90; 102/334; 102/214; 116/214

[58] Field of Search ..... 340/691, 693, 696, 539, 340/90, 590, 385, 825.69, 825.72; 102/336, 418, 427, 214; 116/214

[56] References Cited

U.S. PATENT DOCUMENTS

| | | | |
|---|---|---|---|
| 3,551,906 | 12/1970 | Cooper | 340/539 |
| 3,564,525 | 2/1971 | Robeson et al. | 340/385 |
| 4,591,835 | 5/1986 | Sharp | 340/696 |

*Primary Examiner*—Donnie L. Crosland
*Attorney, Agent, or Firm*—Gregory J. Nelson

[57] ABSTRACT

The work area advanced warning system is for use on the work site to give warning of impending danger in order to give time for workers and others to avoid the danger before the damage. Dangers are sensed by the use of contained exploding charges, smoke and horns or sirens activated by remote control to create unnatural comotion thus alerting the senses to potential loss.

4 Claims, 1 Drawing Sheet

WORK AREA ADVANCED WARNING SYSTEM

BRIEF SUMMARY OF THE INVENTION

It is the primary objective of the present invention to avoid the loss of life and loss of equipment in the construction work area.

Another object of the present invention is to provide a portable system that can be expanded, arranged and adapted to all situations or configurations depending on the dimensions of the work area.

Another object of the present invention is to be able to fire or set off or actuate by remote control, radio control, by wire or other means by person sufficient distance to observe and to act.

Yet another object of the present invention is the provision of the work area advanced warning system of the above type which is efficient in its' manner of operation, relatively inexpensive to manufacture and having a high degree of durability and serviceability.

Briefly, to accomplish the desired objectives of the present invention in accordance with the presently preferred embodiment thereof, there is provided a warning system for use at construction sites.

BRIEF DESCRIPTION OF THE DRAWINGS

Further and more specific objects and advantages of the present invention will become readily apparent to those skilled in the art from following the detailed description thereof taken in connection with the work area advanced warning system.

DETAILED DESCRIPTION OF THE PREFERRED EMBODIMENT

Figure 1:
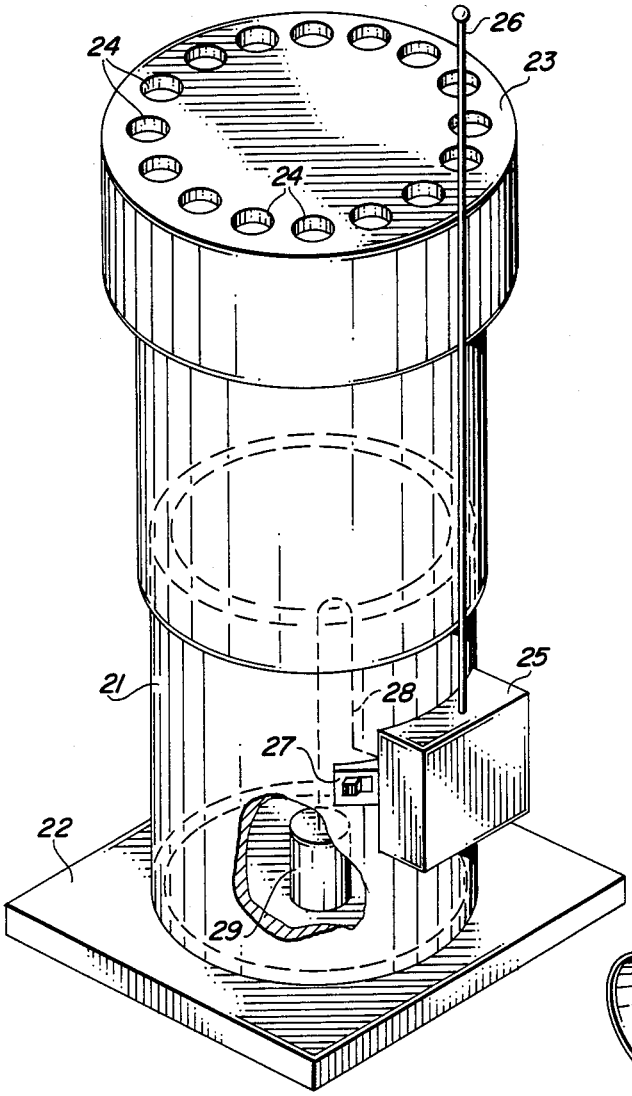
FIG. 1 is an artistic view of the preferred embodiment of the work area advanced warning system of the present invention shown with all parts.

Turning now to the drawings, in which reference numerals indicate corresponding elements through out several views, FIG. 1 illustrates the results when the presently preferred apparatus of the present invention is used. Illustrated are the cylinder shaped body 21, anti tip base 22, weather cap 23, air vents 24, electronic pack receiver or actuating pack 25, antenna 26, safety switch 27, connectors for explosive device 28, explosive charge 29.

Figure 2:
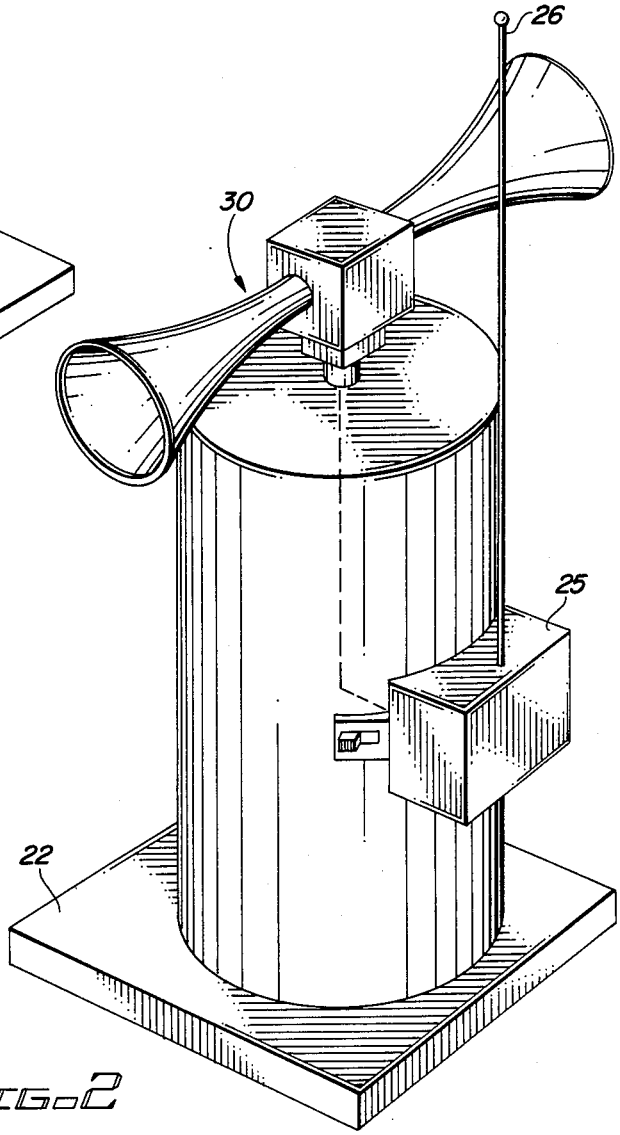
FIG. 2 is an artistic view of the preferred embodiment of the work area advanced warning system of the present invention depicting the sound device.

With particular reference to FIG. 2, there is an anti tip base 22, electronic pack receiver or actuating pack 25, antenna 26, separate horn or siren device 30.

DETAILED DESCRIPTION

This invention relates to warning of impending danger to the work place. More particularly, the invention concerns a system and apparatus to give warning of danger in outdoor work areas such as, but no exclusivly, to roadways, mines, building construction or where noisy or large equipment may impede or otherwise make impossible the comprehension of danger.

In the past on roadway construction, other construction or in mining, the work area safety has been governed by posted signs and flagmen. Warnings have come after the danger has culminated in damage. Failure occurrs when there is a malfunction of equipment or failure of personnel that results in damage because of a failure to perceive the danger. When a vehicle malfunctions or a driver fails to perceive the danger to the work place that work place becomes a danger to the workmen intent on their labors. There is additional danger to others traveling the roadways.

It would be highly advantageous to provide a warning system capable of being actuated by a flagman, operators of equipment, others and persons specifically assigned for safety purposes.

Furthermore, large trucks could be equipped with remote control devices in order to actuate the warning system should the brakes fail, as they frequently do down hills. This use on roadways is only an example and use of the invention and not it's exclusive use.

The equipment should be highly portable and expandable in order to give complete coverage to the whole area.

The apparatus its self should be safe to load, work around, operate and actuate.

I claim:

1. An early warning safety device for warning of an impending dangerous condition in noisy environments, said early warning device comprising:

(a) a base supporting an upwardly extending housing defining an aperture therein;

(b) a receiver secured to said housing operable in response to the reception of a broadcast alarm;

(c) an explosive charge within said housing;

(d) a detonating device adapted to detonate said explosive and operatively connected to said receiver;

(e) audible alarm means associated with said housing; and (f) at least one remotely located transmitter for selectively emitting a broadcast signal upon activation whereby upon receipt of a broadcast signal, said receiver activates said audible alarm giving an audible signal of a potentially dangerous condition and further activates said detonating device exploding said explosive charge to emit smoke through said aperture in said housing.

2. The device of claim 1 further including safety switch means on said detonating device and on said transmitting device for selectively de-activating said devices.

3. The device of claim 1 further including a weather shield selectively removable from said housing.

4. The device of claim 1 wherein said housing is generally cylindrical and said weather shield comprises a generally circular cap with apertures extending about the periphery thereof.

* * * * *